US005094446A

United States Patent [19]

Wiedner

[11] Patent Number: 5,094,446

[45] Date of Patent: Mar. 10, 1992

[54] ROWING EXERCISE MACHINE

[76] Inventor: Joseph F. Wiedner, 670 Jeffersonian Dr., St. Louis, Mo. 63125

[21] Appl. No.: 578,287

[22] Filed: Sep. 6, 1990

[51] Int. Cl.[5] ..... A63B 21/00

[52] U.S. Cl. ..... 272/72; 272/130; 272/73

[58] Field of Search ..... 272/72, 130, 70, 131, 272/117, 118, 68, 67

[56] References Cited

U.S. PATENT DOCUMENTS

| | | | |
|---|---|---|---|
| 1,205,426 | 11/1916 | Barnhill | 272/72 |
| 4,488,717 | 12/1984 | Brown et al. | 272/72 |
| 4,650,181 | 3/1987 | Yang | 272/72 |
| 4,743,010 | 5/1988 | Geraci | 272/72 |
| 4,750,735 | 6/1988 | Fergerson et al. | 272/130 |
| 4,796,881 | 1/1989 | Watterson | 272/72 |
| 4,883,268 | 11/1989 | Salkind | 272/130 |

FOREIGN PATENT DOCUMENTS

| | | | |
|---|---|---|---|
| 2564735 | 11/1985 | France | 272/130 |

*Primary Examiner*—Richard J. Apley
*Assistant Examiner*—Jerome Donnelly
*Attorney, Agent, or Firm*—Gravely, Lieder & Woodruff

[57] ABSTRACT

An exercise machine in the form of a rowing machine having opposed cylinders to reduce heat build-up in the cylinders and to exercise most of the user's muscles during forward and backward movement. The machine has a slidable seat with a stop limiting forward movement to reduce leg bending and consequently lower back strain.

6 Claims, 3 Drawing Sheets

FIG. 2.
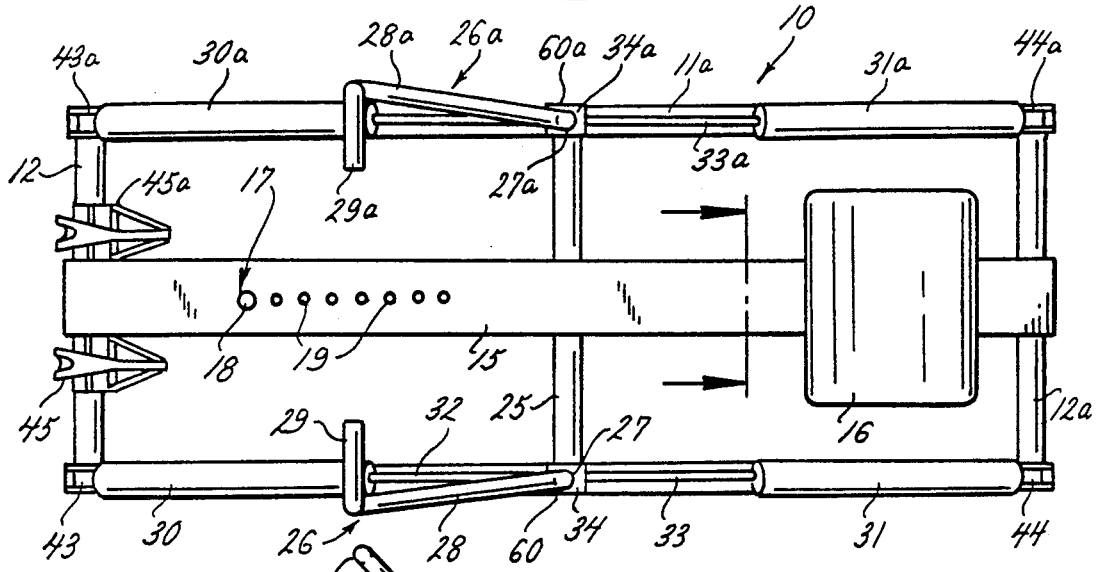
FIG. 1.
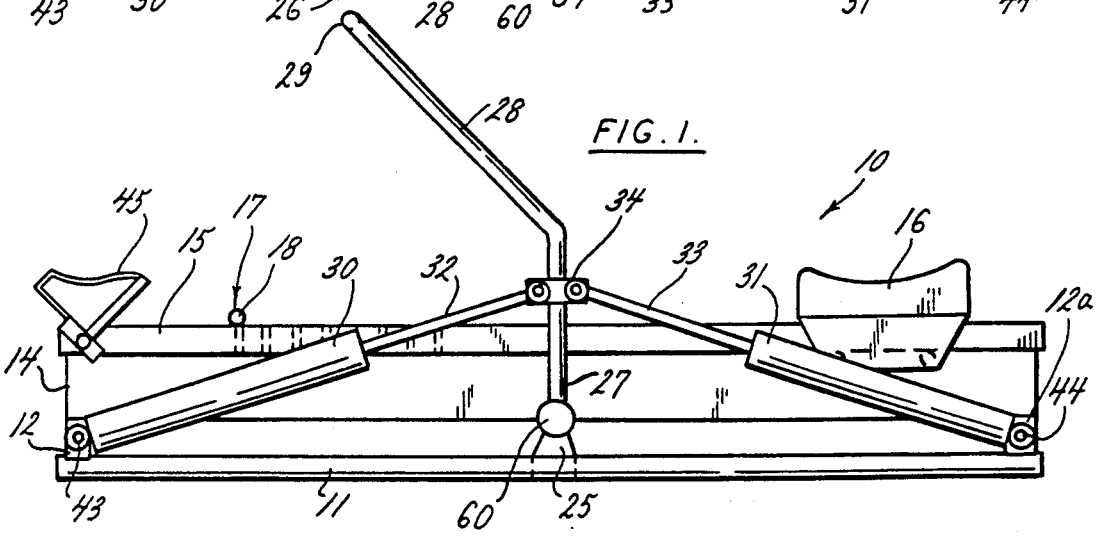
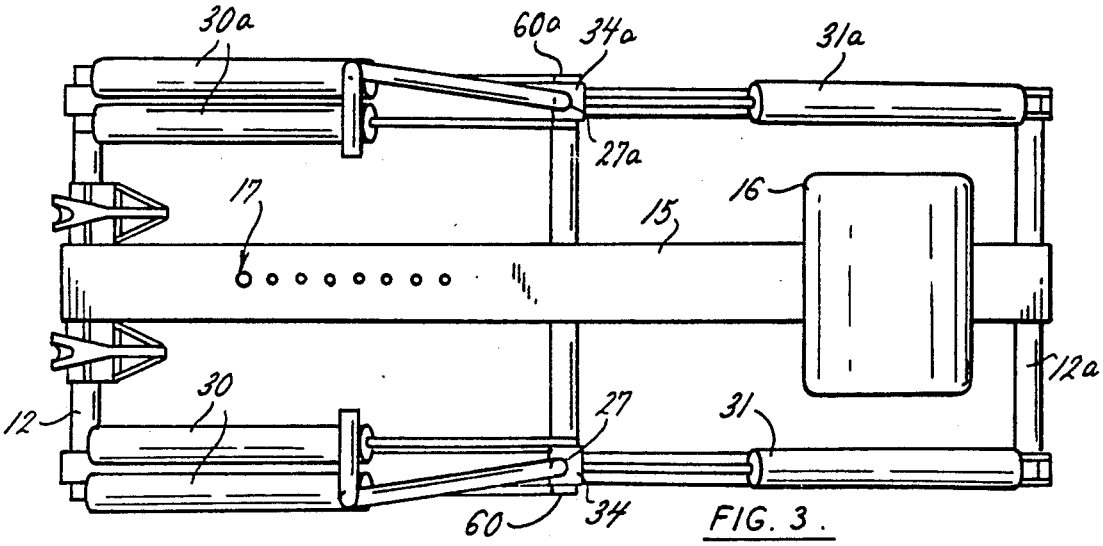
FIG. 3.

FIG. 4.
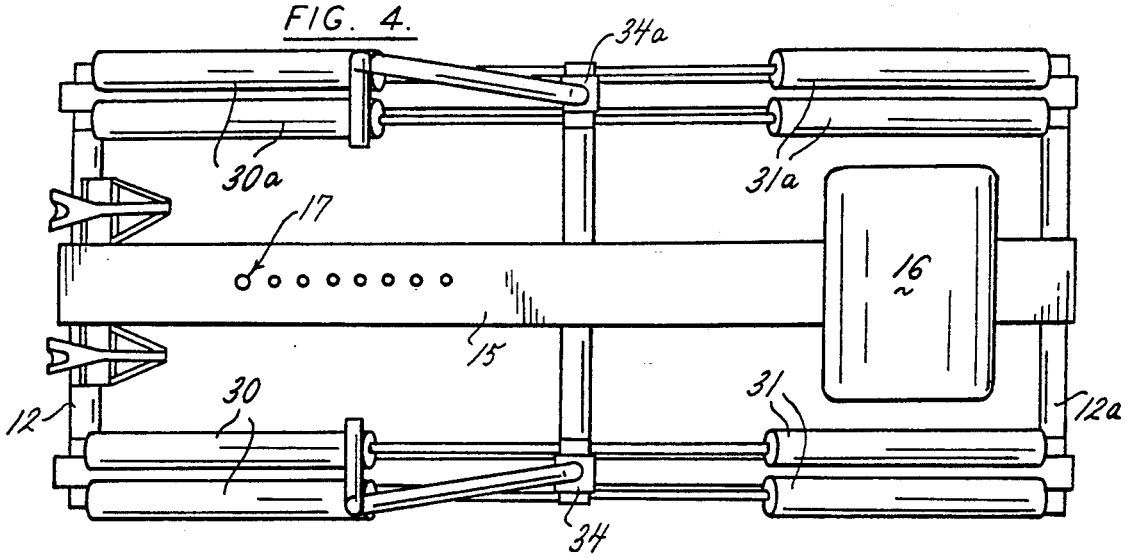
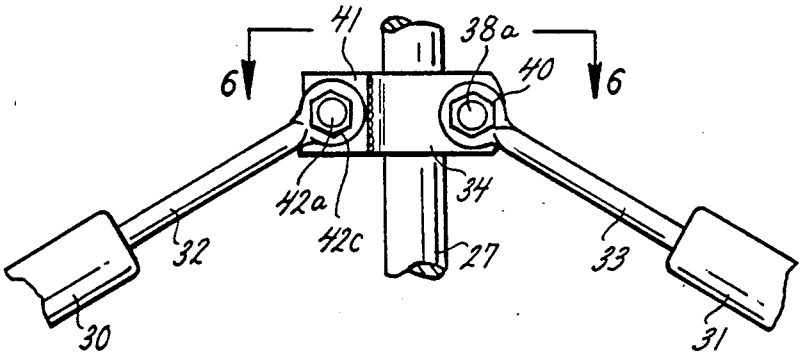
FIG. 5.
FIG. 6.
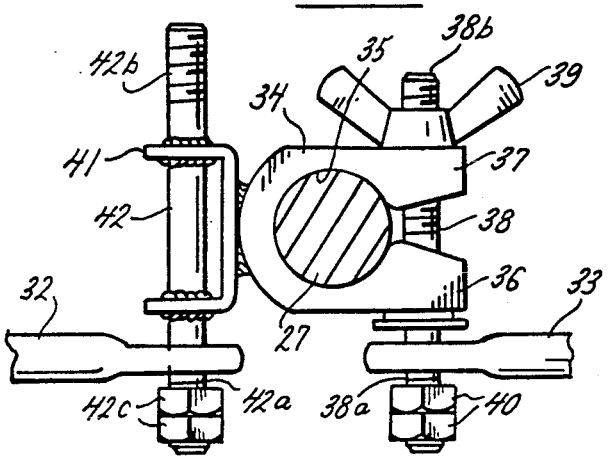

ROWING EXERCISE MACHINE

BACKGROUND OF THE INVENTION

This invention relates to exercise machines and in particular to stationary rowing machines having hydraulic cylinder resistance means. One of the principle objects of this invention is to provide an exercise machine which has opposing cylinders so as to provide resistance for forward motion as well as backward motion to provide for total muscle involvement using the apparatus.

Another object of the invention is to provide an exercise machine having multiple cylinders so as to dissipate the workload and avoid heat buildup which is a principal cause of cylinder failure in this type of mechanism.

Still another object is to provide a rowing machine which alleviates lower back strain caused by over extension of the back resulting from moving the legs into too much of a crouched position. An adjustable seat stop prevents this action by stopping the body of the user from moving forward into the legs so as to restrain the upper and lower legs from coming together such that calves engage the thighs.

Still another object is to provide a rowing machine having a foot rest, which is similar to a bicycle pedal, so as to provide for more efficient transfer of energy and help total muscle involvement.

Another object is to provide a rowing machine which will exercise a substantial number of muscles for the body during the forward and backward movement of the rowing device.

These and other objects and advantages will become apparent hereinafter. The invention also consists in the parts and in the arrangements and combination of parts hereinafter described in the claims.

BRIEF DESCRIPTION OF THE DRAWINGS

In the accompanying drawings which form part of the specification and wherein like numerals and letters refer to like parts wherever they occur—

FIG. 1 is a side elevational view partly in detail of a first embodiment of the invention;

FIG. 2 is a top plan view of the first embodiment of the invention;

FIG. 3 is a top plan view showing a modified embodiment of the invention having dual cylinders on the front of the machine and a single cylinder on the rear of the machine;

FIG. 4 is a top plan view of a further modification of the invention showing dual opposing cylinders on both the front and the back of the rowing machine;

FIG. 5 is a fragmentary plan view of the connection of the front and rear shock absorbers to the movable handle arm;

FIG. 6 is a fragmentary sectional view of the connection shown in FIG. 5 taken along line 6—6;

DETAILED DESCRIPTION OF THE DRAWINGS

Figure 7:
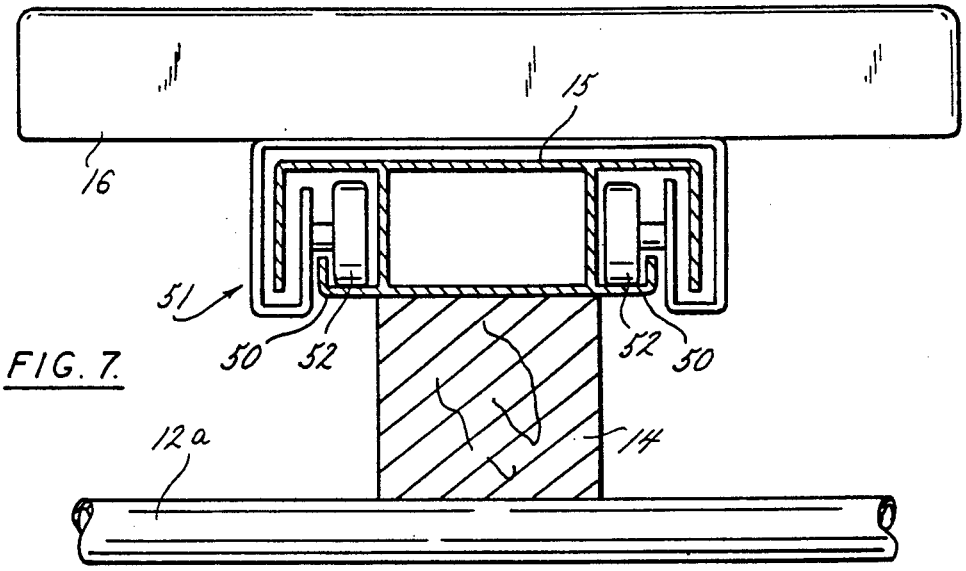
FIG. 7 is an enlarged sectional view of the seat and slide taken along line 7—7 of FIG. 2.
Figure 8:
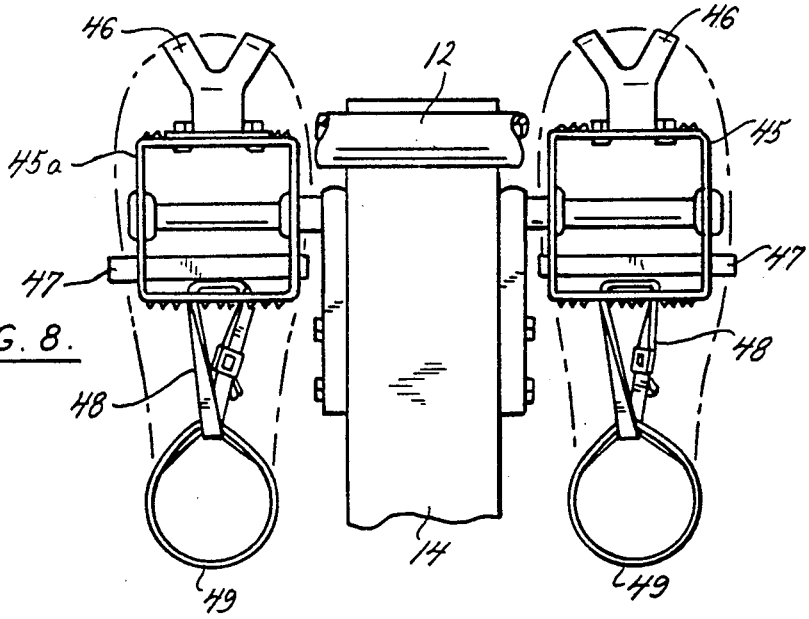
FIG. 8 is a bottom plan view of the pedals.
Figure 9:
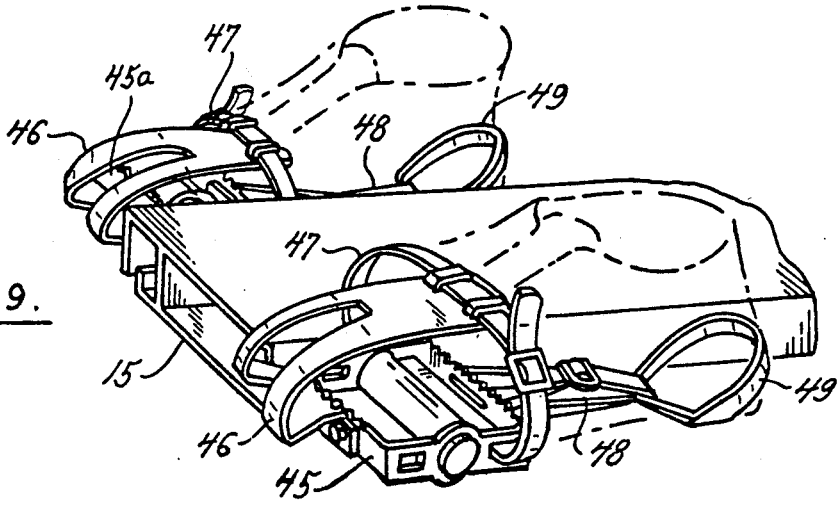
FIG. 9 is an elevational view of the pedals.

FIGS. 1 and 2 show a rigid non-collapsible rowing machine 10 having a base formed of longitudinal runners 11 and 11*a* and lateral cross runners 12 and 12*a* which set on the surface on which the rowing machine

10 is placed. A fixed non-collapsible longitudinal center beam 14 connects the tops of the cross members 12 and 12*a* approximately half the distance between the longitudinal runners 11 and 11*a*. A longitudinal seat support slide 15 is fastened to the top of the center beam 14 and also connects between the cross pieces 12 and 12*a*.

A movable seat 16 is slidingly positioned on the seat support slide 15 and is allowed to move toward and away from the front and rear of the rowing machine 10 as the machine 10 is being used. Adjacent to the front of the rowing machine 10 is an adjustable seat stop means 17 on the seat support slide 15. As shown, the adjustable seat stop means 17 is merely a post 18 adapted to be positioned in a series of openings 19 in the seat support slide 15. The purpose of the adjustable seat stop means 17 is to prevent the body of the user from moving too far forward. When that happens, the user's upper legs and lower legs get too close together which has a tendency to strain the lower back by separating the vertebrae. This has been one of the problems with rowing machines in that the users complain of lower backache or lower back strain. As noted, the seat stop 17 prevents the inner parts of the upper and lower legs of the user from closing together, and this prevents too much stress on the back muscles.

A cross member 25 is positioned between the two longitudinal members 11 and 11*a* approximately intermediate the ends thereof. Pivotally attached to the cross member 25 is a left hand rowing arm 26 and a right hand rowing arm 26*a*. The arms 26 and 26*a* are identical and each has upwardly directed portions 27 and 27*a* which are pivotally connected at one end 60,60*a* to the cross member 25 and which have forwardly directed sections 28 and 28*a* with inwardly directed hand holds 29 and 29*a* to provide a gripping means for the user. Hand grips may be positioned on the hand holds 29 and 29*a*.

Connected between the outer edges of the front lateral member 12 and the rowing arm upright portions 27 and 27*a* are front hydraulic cylinders 30 and 30*a*. Positioned between the outer edges of the rear lateral member 12*a* and the rowing arm upright portions 27 and 27*a* are rear hydraulic cylinders 31 and 31*a*. The cylinders 30,30*a* and 31,31*a* are adjustably positioned along the length of the rowing arm upward portions 27 and 27*a* to change the resistance applied by the cylinders 30,30*a* and 31,31*a*. As shown generally in FIGS. 1 and 2 and in greater detail in FIGS. 5 and 6, the piston rod portions 32,32*a* and 33,33*a* of the cylinders 30,30*a* and 31,31*a* are connected to collars 34 and 34*a* which are slidably adjustable along the upwardly extending rowing arm portions 27 and 27*a*. The force that is needed to operate the rowing machine 10 is reduced as the collars 34 and 34*a* are slid away from the pivot points 60 and 60*a* upwardly along the rowing arm sections 27 and 27*a* toward their intersection with the forwardly extending arm portions 28 and 28*a*.

The collars 34,34*a* are identical. The collar 34 has a curved inner surface 35 and free arms 36 and 37. A stud 38 is fixed to the arm 36 and extends beyond the arms 36 and 37. The stud 38 is threaded on both ends at 38*a* and 38*b*. A wing nut 39 is threaded to the stud end 38*b* and is tightened to fix the collar 34 in position on the handle 27. The rear cylinder rod 33 is rotatably mounted on the stud end 38*a* by lock nuts 40.

A U-shaped front cylinder mounting bracket 41 is attached to the collar 34 and has a stud 42 with threaded end 42*a* and 42*b* fixed thereto. The front cylinder rod 32 is rotatably mounted on the stud end 42*a* by lock nuts 42*c*.

The cylinders 30 and 30*a* are pivotably connected at 43 and 43*a* to the lower outside edges of the front lateral member 12. The cylinders 31 and 31*a* are pivotally connected at 44 and 44*a* to the lower outside edges of the rear lateral member 12*a*.

Fixed to the front of the seat support slide 15 are foot supports 45 and 45*a* which are in the form of bicycle pedal arrangements so as to allow the weight to be transferred to the ball of the foot. This makes for the more efficient transfer of energy and for more total muscle involvement.

The pedals 45,45*a* are standard metal bicycle type pedals. They are identical with bifurcated metal toe clips 46 and adjustable leather toe hold downstraps 47 to secure the foot to the pedal. However, I have improved these pedals by the addition of an adjustable additional strap 48 that runs from the center of the pedal 45,45*a* underneath the foot and has a portion 49 that is looped around the shoe heel to keep the foot from sliding out of the assembly during the exercise. The portion 49 also is adjustable in size.

This arrangement allows for maximum muscle involvement. When pushing with the legs, energy is transmitted from the balls of the feet bringing the calf and all associated leg muscles into play.

When pulling forward with the legs the pedals are the focal point, allowing resistance to be generated while the feet are stationary.

FIG. 3 shows a modification of the present invention in which there are dual cylinders 30,30*a* connected to the front cross member 12, and this allows a dissipation of workload to avoid heat buildup in the cylinders which is a major cause of cylinder failure. This form of the invention requires that the rearward cylinders 31 and 31*a* be positioned on the arm uprights 27 and 27*a* independently of the forward cylinders 30 and 30*a*. Thus separate collars 34 are required for the rear and front cylinders. The independent positioning that is required is about half the distance from the pivot points 60 and 60*a* that the collars for the front cylinders 30 and 30*a* are located.

A further form of the invention is shown in FIG. 4 in which both the front and rear cylinders 30,30*a*, and 31,31*a* are dual. In this configuration, each set of opposed cylinders 30,31 and 30*a*,31*a* attach to single collars 34 and 34*a* along the upward arm sections. However, this form of the invention requires that the second cylinder rod be positioned on the stud ends 38*b* and 42*b* and thus requires an additional stud and wing nut means for locating the collars on the handle arm.

FIG. 7 shows in detail the connection of the seat 16 to the seat support slide or top rail 15. The top rail 15 has longitudinal track members 50 along each side edge and a roller assembly 51 is attached to the under surface of the seat 16. The roller assembly includes rollers 52 which are trapped in and which run in the track 50.

The seat 16 is 10"×12"×2" thick in size. It is made up of medium density closed cell foam. It is soft enough to make extended periods of exercise comfortable, but firm enough so that the user does not sink into the seat, this avoiding unneccesary surface contact with the skin to prevent irritation and chaffing.

The seat roller assembly 51 is constructed so it will slide along the top rail 15 with minimal resistance. The seat roller assembly 51 is designed so there is only a small clearance between the seat 16 and the top rail 15. This minimizes unwanted directional forces on the roller mechanisms 52 and assures a center of gravity close to the top rail 15 to deliver optimal efficiency in executing the exercise.

DESCRIPTION OF OPERATION

The exercise begins with the seat 16 resting against the adjustable stop 18 at the front of the machine 10 with the user's feet fastened to the pedals 45. The user's legs are bent, the upper body is perpendicular to the top of the machine 10, and the arms are fully extended, grasping the handles 29,29*a* of the metal arms 26,26*a*.

The user pushes with the legs so that the seat 16 slides to the rear. The upper body remains perpendicular with the arms still straight. The calves are extended, and the legs are straight. This phase involves the calf, quadricep (upper thigh) and buttocks muscles.

Maintaining fluid movement, the user's legs are kept straight as the arms contract and pull the handles 26,26*a* back to the user's body, stopping when the handles 26,26*a* are parallel with the torso, which is still perpendicular with the head level. This phase involves upper and lower spinal erectors, lattisumus dorsi, trapezius, minor deltoid, upper (bicep), and lower (forearm) involvement.

Once the legs are straight and the handles are parallel to the perpendicular upper body while still maintaining the legs straight and the torso upright, the arms are pressed to a fully extended position. This phase involves pectoralis, deltoids, and triceps, as well as the forearm muscles, with the torso perpendicular and arms maintained in straight position. The seat 16 is made to move forward, pulling with the legs by bending them to a croutched position. The torso is kept perpendicular, the arms are extended, and the head held level. A cycle is completed when the seat 16 reaches the front stop 18. This phase involves the front of the lower legs, leg bicep, and abdominal muscles.

The cycle is repeated as many times is indicated for type of work out, cardiovascular, or both muscular development desired.

During rearward movement, the following muscles are involved:

| | |
|---|---|
| push | calf<br>quadricep - upper leg - buttocks |
| pull | lower back - spinal erectors<br>upper back<br>lattisumus dorsi<br>trapezoid - trapezius<br>minor deltoid involvement<br>upper and lower arm - bicep and forearm |

During forward movement, the following muscles are involved:

| | |
|---|---|
| pull | front of lower leg<br>back of upper leg - bicep and surrounding<br>abdominal muscles |
| push | pectoralis<br>deltoids<br>triceps |

This invention is intended to cover all changes and modifications of the examples herein chosen for purposes of the disclosure which do not constitute departures from the spirit and scope of the invention.

What is claimed is:

1. A rigid non-collapsible rowing exercise machine comprising:

(a) a base having fixed opposed lateral end members;

(b) a seat slidably positioned on said base;

(c) an arm assembly pivotably mounted on said base, said arm assembly including opposed arm members each having an upright portion, one end of which is pivotally mounted on the base and forwardly directed portions on the other end;

(d) linerally aligned sets of opposed cylinders interconnecting the upright portions of the arm assembly to each of the opposed lateral end members such that force is required to move the arm assembly in both a forward and backward motion, the connection between the cylinders and the upright portions of the arm assemblies being vertically adjustable to vary the force needed to operate the machine;

(e) adjustable stop means for limiting forward movement of the seat in proportion to the user's height and leg length without affecting rearward movement of the seat, whereby the bending movement of the lower leg and the upper leg towards each other is limited and over extension of the lower back is reduced; and (f) pedals pivotally mounted on the base forwardly of the seat for engagement with the balls of the user's feet for more efficient total muscle involvement of the user during both forward and rearward operation of the machine, said pedals each having toe clips and straps to secure the foot to the pedal beneath the ball of the foot, and a strap extending from the center of the pedal underneath the foot and around the heel to prevent the foot from sliding out of the pedal during exercise.

2. The machine of claim 1 including sets of dual opposed cylinders linerally aligned on each side of said frame whereby the work energy developed during operation of said machine is dissipated and cylinder failure is reduced.

3. The machine of claim 1 wherein the base comprises spaced longitudinal members connected at their ends by upright lateral members, a slide interconnecting the lateral members, the slide being positioned between the longitudinal members and the seat being mounted on and longitudinally movable along the slide, said adjustable stop means being positioned on the slide between the seat and the front of said base for limiting forward movement of the seat during operation.

4. The machine of claim 1 wherein the base comprises spaced longitudinal members and means interconnecting the same, the arm assembly includes left and right arm members pivotally connected to the longitudinal members intermediate their ends, and each arm member comprises an upwardly extending section pivotably connected at its free end to the adjacent longitudinal member, a forwardly extending portion and an inturned hand support section, and the cylinders are pivotally connected to the upwardly extending arm members and to the ends of the base members.

5. The machine of claim 1 including sets of dual opposed cylinders on each side of said frame whereby the work energy developed during operation of said machine is dissipated and cylinder failure is reduced.

6. The machine of claim 1 including sets of dual cylinders opposed by a single cylinder with each set and the opposed cylinder independently connected to the arm assembly and movable along said arm assembly so that the force required to move the arm assembly forwardly and backwardly can be equalized.

* * * * *